US008905677B2

(12) United States Patent
Hantz

(10) Patent No.: US 8,905,677 B2
(45) Date of Patent: Dec. 9, 2014

(54) SUBSEA FLUID STORAGE SYSTEM AND METHODS THEREFOR

(71) Applicant: Fluor Technologies Corporation, Aliso Viejo, CA (US)

(72) Inventor: Savanna Hantz, Richmond, TX (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 10 days.

(21) Appl. No.: 13/678,305

(22) Filed: Nov. 15, 2012

(65) Prior Publication Data

US 2014/0133922 A1 May 15, 2014

(51) Int. Cl.
*B65D 88/78* (2006.01)
*B65D 90/48* (2006.01)

(52) U.S. Cl.
CPC ..... *B65D 88/78* (2013.01); *B65D 90/48* (2013.01)
USPC ... 405/210; 405/195.1; 405/203; 210/170.01; 210/170.09; 210/170.11; 114/256; 114/257; 137/236.1

(58) Field of Classification Search
CPC ..... B65G 5/00; B65D 88/78; B63B 35/44
USPC ..... 405/195.1, 203, 210; 114/256, 257; 220/720, 721, 723; 137/236.1; 210/170.01, 170.09, 170.11; 441/32
See application file for complete search history.

(56) References Cited

U.S. PATENT DOCUMENTS

| | | | |
|---|---|---|---|
| 3,695,047 | A | 10/1972 | Pogonowski |
| 4,230,422 | A | 10/1980 | Brown |
| 5,582,310 | A | 12/1996 | Del Zotto |
| 7,270,907 | B2 | 9/2007 | Becerra |
| 7,448,404 | B2 | 11/2008 | Samuelsen et al. |
| 7,841,289 | B1 | 11/2010 | Schanz |
| 2011/0215510 | A1 | 9/2011 | Eriksen |
| 2012/0192779 | A1 | 8/2012 | Teppig, Jr. |

FOREIGN PATENT DOCUMENTS

| | | |
|---|---|---|
| FR | 2807745 | 10/2001 |
| JP | 2721889 | 3/1998 |
| JP | 2001-163393 | 6/2001 |
| WO | 2011/084164 | 7/2011 |

OTHER PUBLICATIONS

Patent Cooperation Treaty, "Notification of Transmittal of the International Search Report and the Written Opinion of the International Searching Authority, or the Declaration", PCT Application No. PCT/US2012/065313; issued May 10, 2013.

*Primary Examiner* — John Kreck
*Assistant Examiner* — Carib Oquendo
(74) *Attorney, Agent, or Firm* — Fish & Tsang, LLP

(57) ABSTRACT

The inventive subject matter provides apparatus, systems and methods by which one can safely and effectively store fluids in undersea environments. Fluid is stored in a flexible bladder that is at least partially enclosed in a vessel. The bladder is coupled to a support, which supports the weight of the bladder with the aid of a support driver. A sensor may be used to monitor the position of the support, allowing determination of the volume of the bladder.

15 Claims, 7 Drawing Sheets

SUBSEA FLUID STORAGE SYSTEM AND METHODS THEREFOR

FIELD OF THE INVENTION

The field of the invention is fluid storage, and in particular fluid storage in a subsea environment.

BACKGROUND

Subsea storage of liquid products utilized in various undersea operations has been proven to be a practical and economical alternative to providing such products at depth from surface storage. A subsea storage facility is substantially protected from adverse weather, and also present a wide variety of potential storage spaces not limited by the needs of surface transport or installation. They are particularly desirable for use with offshore petroleum installations and fields. In addition to petroleum and other hydrocarbons that are released at the wellhead and may require storage, a variety of other fluid compounds or additives may be stored at production wells and processing units. These fluid compounds/additives may be utilized, for example, to assist in drilling, control corrosion, reduce scale buildup, stabilize emulsions, and control the formation/buildup of undesirable compounds (such as hydrates, hydrogen sulfide, asphaltenes, and inorganic compounds). Such subsea storage, however, necessarily introduces the potential for contamination of the surrounding water by stored liquids, either through the design of the storage system (which may equalize external and internal pressures by admitting water from the environment) or by accidental release. Ideally, such subsea fluid storage systems should provide for safe storage of a variety of fluids in such a way that the risk of environmental contamination is minimized. Due to the inherent difficulties in observing such systems directly the ability to monitor the state of such systems remotely is also highly desirable.

For example, U.S. Pat. No. 3,695,047 (to Pogonowski et al) discloses a subsea storage system for fluid with densities less than that of water, in which the stored fluid is held in a concrete tank with a convex top that resists the pressure applied by the buoyant fluid in storage. While the use of concrete reduces or eliminates corrosion issues, in this system pressure between the inside and the outside of the tank is equalized by placing the interior of the storage tank in fluid communication with the surrounding sea. The stored liquid "floats" on the water held within the tank, and so directly provides an opportunity for contamination of the surrounding water. This issue is addressed to some extent in U.S. Pat. No. 4,230,422 (to Brown et al), which provides a jacketing water tank that surrounds the storage tank and provides an area where low density, immiscible liquids that escape from storage may be easily separated from water. In addition, the external tank provides a measure of protection from accidental collisions. Unfortunately, such systems are limited to the storage of fluids that have a density lower than that of water and that are essentially immiscible in water, as no physical barrier is provided between the stored fluid and the subsea environment. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Fluid containment systems that provide such barriers have been proposed. U.S. Patent Application No. US2011/0215510 (to Erikson) describes methods for forming pressure resistant molded metal tanks that are suitable for fluid storage and that do not require pressure equalization with the environment. Unfortunately, such metal tanks are subject to corrosion in the subsea environment. In addition the size of such tanks is necessarily limited by the strength of the materials utilized and the relatively extreme conditions encountered in the manufacturing process. The use of flexible bladders, such as those supplied by Aero Tec Laboratories (Ramsey, N.J. U.S.A. 07446) for subsea storage of fluids has also been explored. Such devices, however, do not provide a high degree of protection from accidental collisions that may cause a flexible bladder to rupture. In addition, it is not apparent how the fill volume of such a device may be easily monitored.

Various designs that store fluid in a flexible bladder that is encased in a shell or vessel have also been proposed. Such designs provide a physical barrier between the stored fluid contents and the environment, however due to the flexible and pliant nature such a barrier there is a risk of cracking, tearing, or other losses of integrity where the material of the barrier is stressed. Such stresses may originate from inadvertent collisions and/or from stresses resulting from the weight of the bladder and/or bladder contents. This is particularly true when such stresses are applied to areas where the bladder is in contact with rigid materials, such as the wall of a containment vessel and/or a filling conduit. U.S. Pat. No. 7,841,289 (to Schanz) discloses a streamlined tank with a collapsible internal bladder that is used for fluid storage and with a liquid port to the external environment. Unfortunately, these disclosed devices are designed to float at the surface as they are towed between locations and lack numerous features necessary for subsea storage. Additional fluid storage systems that utilize an enclosed collapsible or flexible bladder are disclosed in French Patent No. 2,807,745 (to Gabe) and in U.S. Pat. No. 7,270,907 (to Becerra and DeFilippis). Unfortunately, neither of these provide for pressure equalization with the external environment or provide a mechanism for relieving stresses on the flexible bladder. Still further, there are no provisions for remote sensing of the fill state of the storage system.

Thus, there is still a need for a subsea storage systems and methods that provides safe, effective, and economical storage of fluids, especially where fluids are stored in a subsea environment.

SUMMARY OF THE INVENTION

The inventive subject matter provides apparatus, systems, and methods by which one can safely and effectively store fluids in subsea environments. Fluid is stored in a flexible bladder that is at least partially enclosed in a perforate vessel, where the openings allow for equalization of pressure between the inside and the outside of the perforate vessel as the flexible bladder changes in volume. The perforate vessel is anchored or otherwise secured to the seabed. The flexible bladder may be filled through a flange (such as a neck flange) that protrudes or extends through an opening in the perforate vessel. This flange may serve as an interface with a conduit that is utilized to fill and/or empty the subsea storage system. The bladder is coupled to a support, which is moved towards the flange so as to brace the flange against the weight of the bladder and/or the contents of the bladder. As the bladder is filled it presses against the support, moving it distal to the flange along a guide. A sensor may be used to monitor the position of the support (which moves in concert with the flexible bladder as it is filled and/or emptied) and can provide a signal or data stream that can be utilized by a controller to allow determination of the volume or fill state of the flexible bladder.

One embodiment of the inventive concept is a subsea fluid storage system that includes a perforate vessel (that is, a vessel with one or more apertures), a flexible bladder that includes a neck flange and that is coupled to and at least partially disposed within the perforate vessel, a support (which can be an axle) that is attached or coupled to the flexible bladder and is movably coupled to the perforate vessel, a support driver that can move at least a portion of the support towards the neck flange of the flexible bladder, an anchoring device and/or element that is coupled to the perforate vessel and is configured to secure the perforate vessel to a seabed or other suitable subsea feature, and a sensor that is operationally coupled to the support and is configured to generate a signal and/or data stream that is a function of the position of the support (and/or a portion thereof). The flexible bladder may be designed or configured to be movable between a first state (in which support, or a portion thereof, is proximal to the neck flange) and a second state (in which the support, or a portion thereof) is distal to the neck flange. In some embodiments of the inventive concept the support is arranged or configured to brace the neck flange when the subsea fluid storage system is in this first state. The support driver may be a resilient member, and in some embodiments of the inventive concept may be coupled to a terminus of the support. Alternatively, the support driver (or a portion thereof) may be within a lumen of the support. In other embodiments of the inventive concept the support may be coupled to the flexible bladder. In some embodiments of the inventive concept the fluid storage system may include a controller that receives a signal and/or data stream from a sensor and converts the signal into data that indicates the fill state and/or volume of the flexible bladder.

Another embodiment of the inventive concept is a flexible bladder assembly for subsea fluid storage that includes a flexible bladder (which forms a reservoir for subsea fluid storage) with a neck flange and a bladder terminus that includes a support anchor, where the neck flange supports and/or retains the flexible bladder in a subsea perforate vessel. The flexible bladder may be configured to move between a first state (in which the support anchor is proximal to the neck flange) and a second state (in which the support anchor is distal to the neck flange). The flexible bladder assembly may also include a support that is configured to move between a first state that is coincident with the first state of the flexible bladder and a second state that is coincident with the second state of the flexible bladder. In some embodiments of the inventive concept, the flexible bladder assembly includes a sensor that can provide a signal and/or data that differentiates between the first state of the support and the second state of the support to a controller.

Another embodiment of the inventive concept is a method for subsea fluid storage in a subsea fluid storage system, in which a fluid is introduced to an interior of a flexible bladder of the subsea fluid storage system through a neck flange and thereby displaces a support (or a portion of a support) from the neck flange distally along a guide of the subsea fluid storage system. Fluid may be introduced to (and/or removed from) the fluid storage system via a conduit that is in fluid communication with the neck flange. Fluid is removed from the interior of the flexible bladder using an actuator, thereby moving the support (or a portion thereof) in a proximal direction to the neck flange. The support, or a portion thereof, may be moved by reversibly deforming the flexible bladder from a second to a first state or between a second state and a first state. In this process fill state and/or volume of the flexible bladder may be measured by a sensor that is operationally coupled to the support, or a portion thereof. Such a sensor may be configured to supply a signal and/or data that is related to the position of the support; this signal and/or data may be utilized to estimate the volume of the flexible bladder. In some embodiments of the inventive concept the neck flange of the flexible bladder may be braced by the support when the flexible bladder is empty. Fluids that are stored by a method of the inventive concept include chemicals utilized for chemical injection in deep sea petrochemical operations, back flush liquids from deep sea petrochemical operations, discharge from deep sea petrochemical operations, gases utilized in deep sea petrochemical operations, and gases produced by deep sea petrochemical operations.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 1 shows an embodiment of the inventive concept.

FIG. 2 shows an alternative embodiment of the inventive concept.

FIG. 3 shows another embodiment of the inventive concept.

DETAILED DESCRIPTION

Figure 1A:
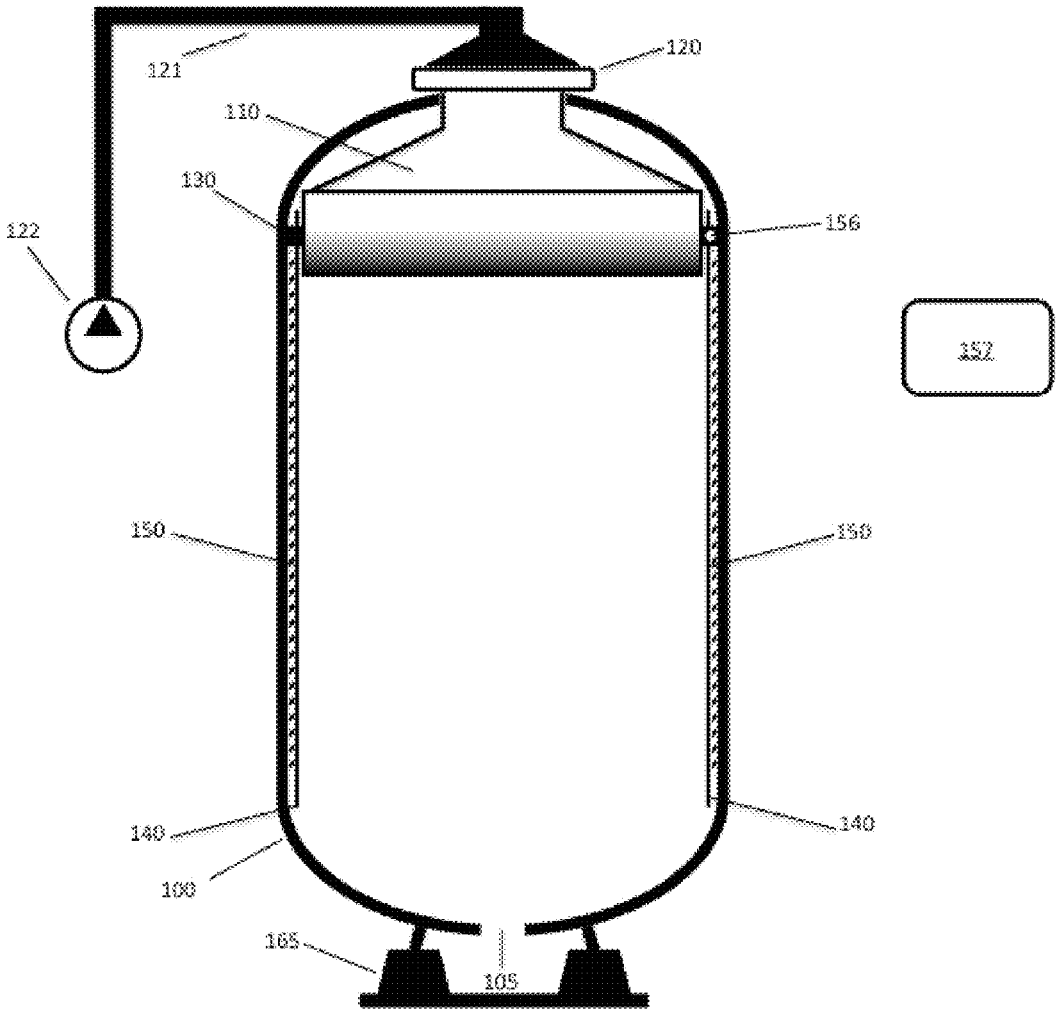
FIG. 1A illustrates a subsea fluid storage system utilizing a flexible bladder, where the flexible bladder is empty.

It should be noted that while the following description is drawn to a subsea storage system utilizing a flexible bladder that is at least partially held within a rigid vessel, various alternative configurations are also deemed suitable and may utilize a plurality of independent bladders held within a single vessel, a plurality of interconnected bladders held within a single vessel, a bladder with one or more internal partitions, a bladder that incorporates one or more baffle structures, a bladder with a plurality of flanges or neck flanges that permit injection and/or withdrawal of fluid, and/or a vessel that is semi-rigid or pliant. In addition, the flexible bladder may have a homogeneous or heterogeneous composition, and may incorporate one or more rigid segments. In especially preferred embodiments, the subsea storage system utilizes materials and compositions that are compatible with fluids produced by and/or utilized in the petrochemical industry.

One should appreciate that the disclosed techniques provide many advantageous technical effects including improved protection of stored fluids from the hostile subsea environment, reduction or elimination of tears or ruptures that may result in the undesirable release of such fluids, and the ability to monitor the fill state of such a storage system remotely.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventive subject matter provides apparatus, systems and methods by which one can safely and effectively store fluids in undersea environments. As such a subsea storage system of the inventive concept may be configured to be functional at depths of greater than 100 meters. In some embodiments of the inventive concept the subsea storage system is configured to be functional at depths greater than 1,000 meters. In a preferred embodiment of the inventive concept the subsea storage system is configured to be functional at depths greater than 3,000 meters. Fluid is stored in a flexible bladder that is at least partially enclosed in a perforate vessel. This vessel provides protection for the flexible bladder from subsea hazards. Use of a perforate vessel (i.e. a vessel with one or more apertures or perforations that place the interior of the vessel in fluid communication with the environment) advantageously allows for rapid and effective equilibration of pressure between the inside and the outside of the vessel as the bladder changes in volume without the need for complex pumps and control equipment, extending the range of volumes over which a subsea fluid storage system of the inventive concept may be utilized. The bladder may be filled and/or emptied through a flange (such as a neck flange) that extends through an opening or aperture in the perforate vessel. This flange may engage a conduit, pipe, umbilicus, or similar structure to form a seal that provides direct access to the interior of the flexible bladder. The flexible bladder is coupled to a support, which is moved towards the flange so as to brace the flange against the weight of the bladder and to thereby relieve stress that may be applied to this flange by the weight of the bladder and/or its contents. As the flexible bladder is filled from an empty state it deforms reversibly, distending to press against the support and causing the support to move along a guide until the flexible bladder reaches a filled state. In this process, the support may compress or otherwise transfer energy to a support driver, which in turn supplies force to the support that is directed to and/or moves the support towards the flange. Since movement of the support is coupled to the changing volume of the bladder used for fluid storage, data related to the position of the support may be advantageously utilized to provide information related to the fill state of the flexible bladder. A sensor may be used to monitor the position of the support and provide data and/or a signal related to this position. A controller, such as a computer or similar computational device, may utilize this information to determine of the volume of the bladder. This advantageously provides information related to the fill state of the subsea storage system in environments where it may not be conveniently observed directly. The support, guide, and/or the flexible bladder may incorporate features that allow the flexible bladder to be compacted or packed in an orderly manner as the flexible bladder is emptied. The manner of packing may be selected to prevent entanglement or snagging of the flexible bladder upon being filled, for example by encircling the flexible bladder around the support. In some embodiments of the inventive concept the subsea storage system can include an anchoring element that is coupled to the perforate vessel and may serve to affix the subsea storage system to a stationary object, such as the seabed. Suitable anchoring elements include (but are not limited to) anchors, grapples, clamps, suction piles, and/or ballasted foundations.

Figure 1B:
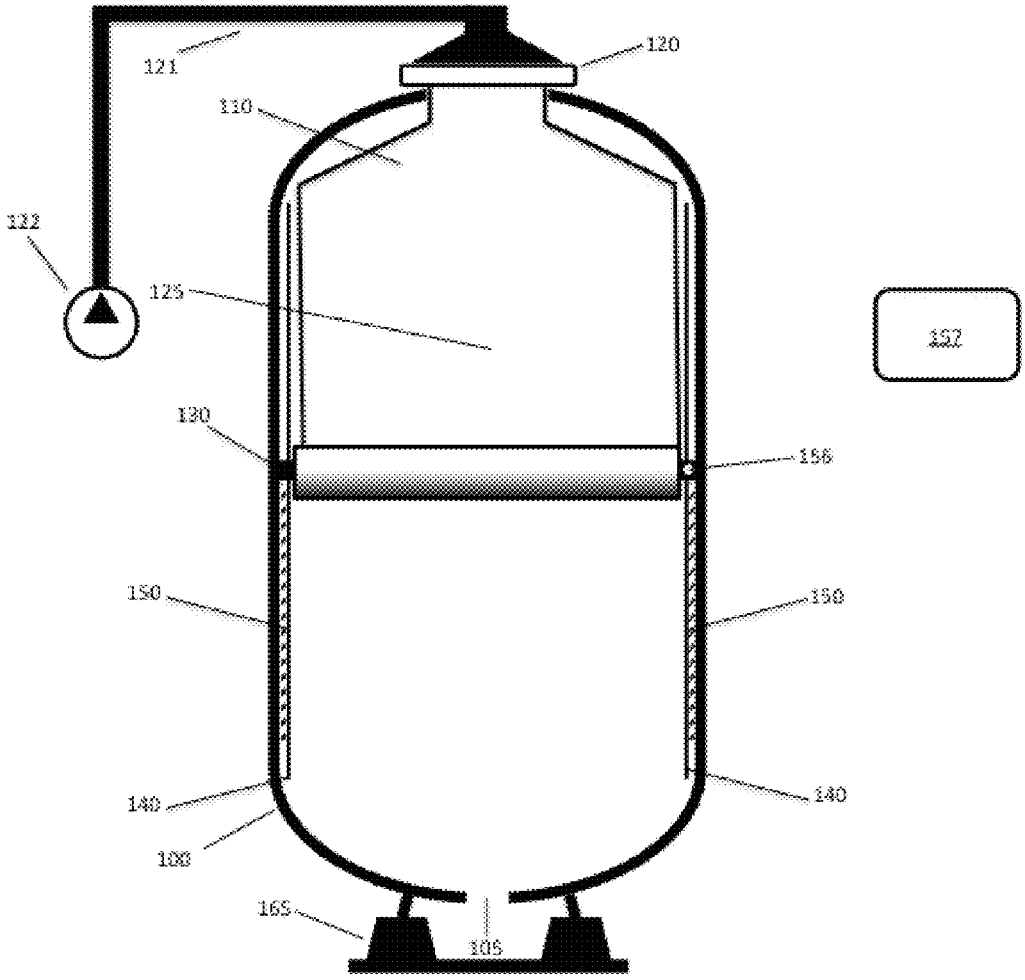
FIG. 1B illustrates the same system with the flexible bladder partially filled.
Figure 1C:
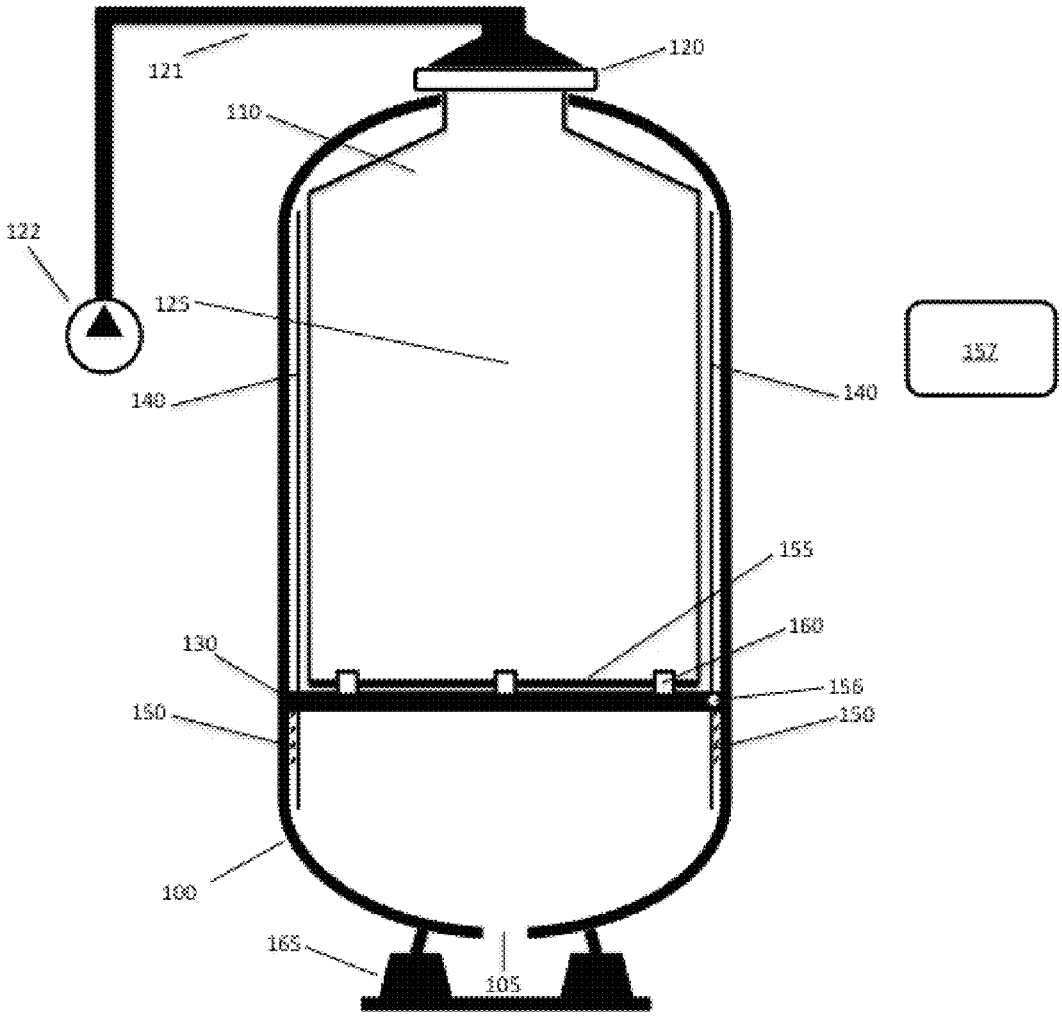
FIG. 1C illustrates the system with the flexible bladder filled.

FIGS. 1A-1C illustrate an embodiment of the inventive concept. In FIG. 1A a perforate vessel 100 encloses a flexible bladder 110 that includes a flange 120 (for example, a neck flange). The perforate vessel 100, which can serve to protect the flexible bladder 110, is perforated—including an aperture through which the flange 120 may extend and one or more other openings 105 that permit pressure within the perforate vessel 100 to be equalized with external pressures as the volume of the bladder changes. A conduit 121 (such as a pipe or similar structure) may be utilized in conjunction with an actuator 122 (for example, a pump) to transfer fluids to and/or from the flexible bladder 110 through the flange 120. An anchoring element 165 may be affixed to the perforate vessel 100, permitting the subsea storage system to be fixed in place. Such an anchoring element 165 may, for example, affix the perforate vessel to the seabed and/or a portion of an existing subsea structure. Placement of an opening 105 towards the seabed advantageously permits containment of low density fluids that may escape from the flexible bladder 110 while supporting pressure equalization. It should be recognized, however, that numerous other arrangements may be suitable. Such other arrangements can include, but are not limited to, the use of porous materials in construction of the perforate vessel 100, the use of multiple openings through perforate vessel, and the use of a cage and/or net that encompasses the flexible bladder 110.

FIG. 1A shows an embodiment of the inventive concept in which the flexible bladder 110 is empty, and wrapped around a support 130 in a circular or helical fashion. It should be appreciated, however, that other packing arrangements for the flexible bladder 110 may be utilized. Suitable supports include, but are not limited to, an axle, a shaft, a rod, or other suitable structure. The support 130 is engaged in a guide 140 that directs its movement along the inner wall of the perforate vessel 100, and is moved towards the flange 120 by a support driver 150. The support driver 150 can be a resilient body and/or member that applies force to the support 130. In some embodiments of the inventive concept the support driver 150 and support 130 are arranged so that force is applied when the flexible bladder 110 has a density greater than that of the surrounding media, and/or the support is proximal to the flange 120. It should be appreciated that the density of the flexible bladder 110 may be a function of its composition, its fill state, and the nature of the fluid and/or fluids contained therein. As such, the support 130 may apply force to the flexible bladder 110 when it is in an empty or partially filled state. This advantageously braces the flange 120, relieving stress from the weight of the flexible bladder 110 and reducing or eliminating the possibility of tearing of the flexible bladder 110. Suitable support drivers include (but are not limited to) springs, resilient polymers and/or rubbers, and/or pneumatic devices. Alternatively, a cable and pulley system may be utilized to actuate support 130, for example via a counterweight. In a preferred embodiment the support driver is a compression spring that lies within a guide 140 that engages a portion (for example, a terminus) of the support 130. Suitable guides 140 include (but are not limited to) a channel, a track, a groove, or similar structure that is configured to engage the support 130. Alternatively, a guide may be a cable or line that engages a loop or similar engaging structure of the support 130. A sensor 156 may be utilized to provide a signal or data stream that is related to the position of the support 130. This signal may, in turn, be transmitted or otherwise provided to a controller 157 and utilized to determine the fill state of the flexible bladder 110, as detailed below.

As shown in FIG. 1B, which shows an embodiment of the inventive concept in a partially filled state, as the flexible bladder 110 is filled it deforms—unrolling and/or disengaging from the support 130 as a reservoir portion 125 expands. This deformation may be reversible, returning the flexible bladder 110 to its unfilled conformation or state as it is emptied. In this process the support 130 moves away from the flange 120 along a guide 140 and compresses the support driver 150. It should be appreciated that this increase in the volume of the flexible bladder 110 does not result in an increase in pressure within the perforate vessel 100 due to its perforate nature.

As noted above, a sensor 156 may be utilized to provide a signal or data related to the position of the support 130. In some embodiments of the inventive concept one or more sensor(s) 156 may be associated with the support 130 and/or a support anchor 160, and configured to provide a signal on sensing features incorporated into the guide 140. For example, contact, magnetic, and/or optical flags may be placed along the guide 140 that provide a signal when proximate to a sensor 156. Alternatively, a plurality of sensors may be associated with the guide 140, and configured to provide a signal on sensing the passage of the support 130 and/or a support anchor 160 as the volume of the flexible bladder 110 changes. In still other embodiments of the inventive concept, a sensor 156 may monitor movements made by the support 130 (for example, measuring rotation of the support 130 via an accelerometer or characterizing distance of the support 130 from an ultrasonic sensor affixed to the perforate vessel 100). In yet other embodiments of the inventive concept a sensor 156 may monitor energy stored in the support driver 150, for example through the use of a force sensor. It should be appreciated that while FIGS. 1A-1C show a sensor 156 that is proximal to a support 130, it is envisioned that such a sensor 156 may be positioned at any location suitable to its function. The sensor signal may be transmitted or otherwise provided to a controller 157, which may utilize such data to determine the volume of the flexible bladder 110. For example, data related to the position of the support 130 within the perforate vessel 100 may be utilized by a controller 157 in conjunction with data related to the geometry of the flexible bladder 110 to derive a fill volume for the flexible bladder 110. Alternatively, fill volume may be obtained empirically by filling the flexible bladder 110 with one or more known volumes of fluid and recording a signal related to the position of support 130 at each volume prior to deployment of the subsea storage system. A controller 157 could be configured to compare signals obtained from a sensor 156 in the field to such data and report a fill state or volume for the flexible bladder 110. Such information may be utilized to, for example, optimize plant operations by distributing fluid storage to different members of a series of storage systems or to provide a notice or warning to an operator.

FIG. 1C shows an embodiment of the inventive concept in a filled state. In some embodiments of the inventive concept the support 130 may be coupled to a terminus 155 of the flexible bladder 110 and at least partially exposed when the flexible bladder 110 is filled. The support 130 may be coupled to the flexible bladder 110 at one or more support anchor(s) 160, which can be located at or near the terminus 155 of the flexible bladder 110.

When fluid is removed from the flexible bladder 110 the filling process is essentially reversed, with force from the support driver 150 moving the support 130 towards the flange 120 along the guide 140. Removal of the contents of the flexible bladder may be accomplished through the use of an actuator 122 (for example, a pump) that is in fluid communication with a conduit 121, which is in turn in coupled to a flange 120. The flexible bladder 110 may be wrapped around the support 130 (or otherwise gathered or collected) as it moves towards the flange 120. In some embodiments of the inventive concept the guide 140 may include features that imparting a rotational motion to the support 130 as it moves along the guide 140. For example, the guide 140 may include teeth and/or cams that engage complementary features on the support 130 and impart a rotational motion as the support moves along the guide 140.

Figure 2A:
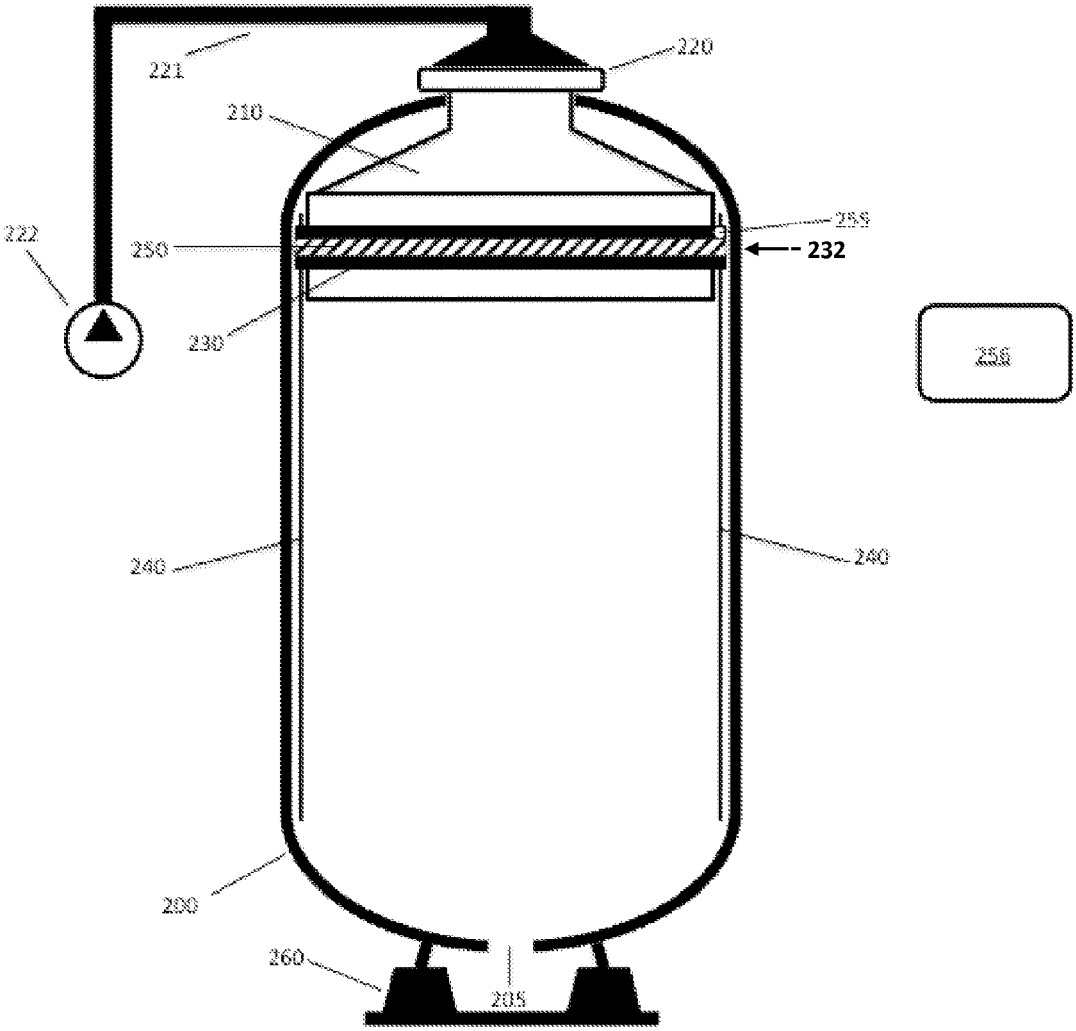
FIG. 2A illustrates a subsea fluid storage system utilizing a flexible bladder, where the flexible bladder is empty.
Figure 2B:
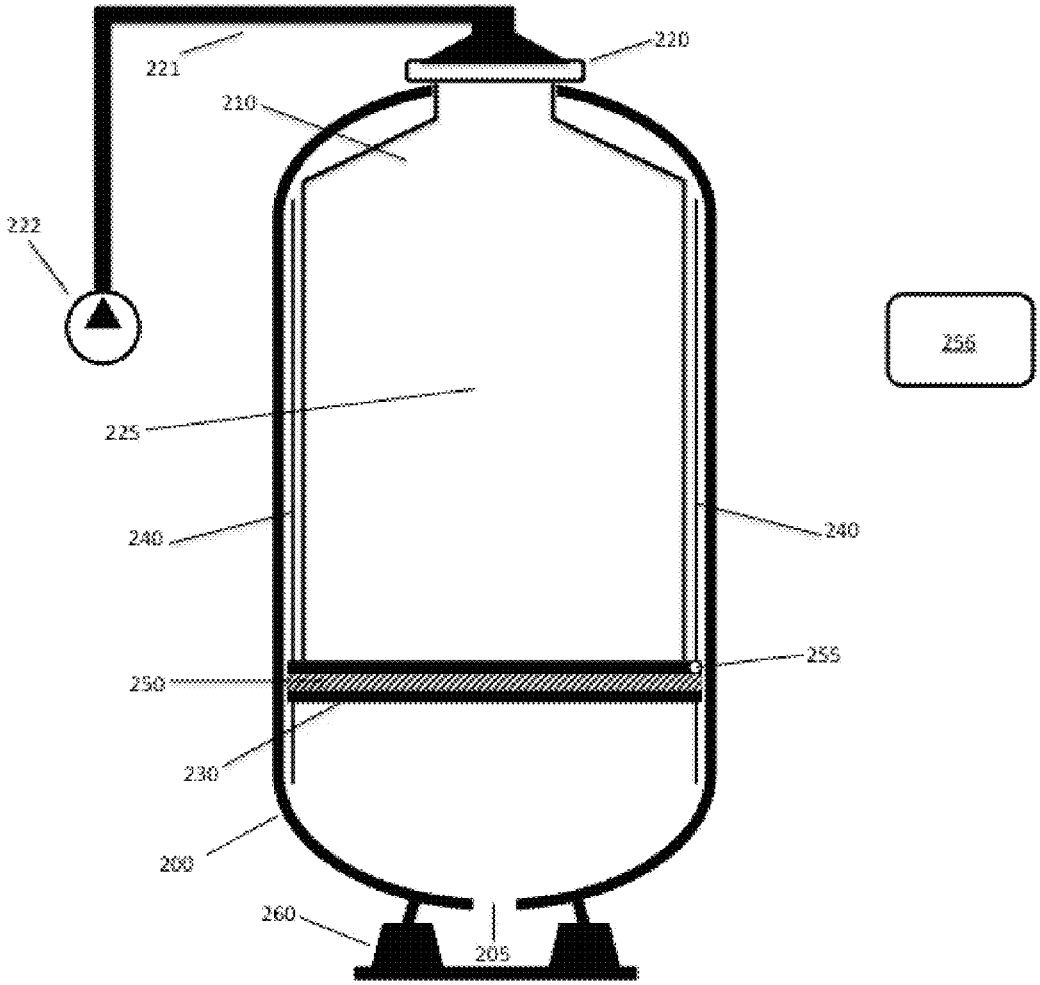
FIG. 2B illustrates the system with the flexible bladder filled.

Another embodiment of the inventive concept is shown in FIGS. 2A-2B. FIG. 2A shows a flexible bladder 210 within a perforate vessel 200 that includes an aperture through which extends a flange 220 (such as a neck flange) of the flexible bladder 210 and an opening 205 that permits equalization of pressure between the inside and the outside of the perforate vessel 200; in the state shown the flexible bladder 210 is empty or nearly empty. A conduit 221 (such as a pipe or similar structure) may be utilized in conjunction with an actuator 222 (for example, a pump) to transfer fluids to and/or from the flexible bladder 210 through the flange 220. An anchoring element 260 may be affixed to the perforate vessel 200, permitting the subsea storage system to be fixed in place. Such an anchoring element 260 may, for example, affix a perforate vessel 200 to the seabed and/or a portion of an existing subsea structure. A portion of the flexible bladder 210 encircles or is wrapped around a support 230 (it should be appreciated, however, that other packing arrangements may be utilized). This is shown in a cutaway view to reveal the interior of the support 230, which includes a lumen 232 that holds a support driver 250. The support 230 engages a guide 240, which controls and/or guides its movement as the flexible bladder is filled. Suitable support drivers include (but are not limited to) a spring, resilient polymer and/or rubber, cable, and/or any suitable device for storing torsional or rotational energy. In a preferred embodiment of the inventive concept, the support driver 250 is a torsion spring. In some embodiments of the inventive concept the support driver 250 and support 230 are arranged so that force is applied when the flexible bladder 210 is empty and/or has a density greater than that of the surrounding media, and/or when the support is proximal to the flange 220. This advantageously braces the flange 220, relieving stress from the weight of the flexible bladder 210 and reducing or eliminating the possibility of tearing of the flexible bladder 210.

FIG. 2B illustrates an embodiment of the inventive concept wherein the flexible bladder 210 is filled to near or at capacity. It should be noted that at least a portion of the support 230 may be exposed when the flexible bladder 210 is filled to capacity or near capacity. As the flexible bladder 210 is filled a reservoir portion 225 distends and is released from the support 230; in doing so the support 230 moves away from the flange 220 and along the guide 240. A sensor 255 may be utilized to provide a signal or data related to the position of the support 230. The signal from such a sensor 255 may be utilized by a controller 256 to provide information related to the fill state or volume of the flexible bladder 210.

As noted above, a sensor 255 may be utilized to provide a signal or data related to the position of the support 230 or structures associated with or coupled to the support. In some embodiments of the inventive concept one or more sensor(s) 255 may be associated with the support 230, and configured to provide a signal on sensing features incorporated into the guide 240. For example, contact, magnetic, and/or optical flags may be placed along the guide 240 that provide a signal when proximate to a sensor 255. Alternatively, a plurality of sensors may be associated with the guide 240, and configured to provide a signal on sensing the passage of the support 230 as the volume of the flexible bladder 210 changes. In still other embodiments of the inventive concept, the sensor 255 may monitor movements made by the support 230 (for example, measuring rotation of the support 230 via an accelerometer or characterizing distance of the support 230 from an ultrasonic sensor affixed to the perforate vessel 200). In yet other embodiments of the inventive concept a sensor 255 may monitor energy stored in the support driver 250, for example through the use of a force and/or torsion sensor. It should be appreciated that while FIGS. 2A-2B show a sensor 255 that is proximal to a support 230, it is envisioned that such a sensor 255 may be positioned at any location suitable to its function. The sensor signal may be transmitted or otherwise provided to a controller 256, which may utilize such data to determine the volume of the flexible bladder 210. For example, data related to the position of the support 230 within the perforate vessel 200 may be utilized by a controller 256 in conjunction with data related to the geometry of the flexible bladder 210 to derive a fill volume for the flexible bladder 210. Alternatively, fill volume may be obtained empirically by filling the flexible bladder 210 with one or more known volumes of fluid and recording a signal related to the position of support 230 at each volume prior to deployment of the subsea storage system. A controller 256 could be configured to compare signals obtained from a sensor 255 in the field to such data and report a fill state or volume for the flexible bladder 210. Such information may be utilized to, for example, optimize plant operations by distributing fluid storage to different members of a series of storage systems or to provide a notice or warning to an operator.

In some embodiments of the inventive concept this movement of the support 230 also transfers energy to the support driver 250. For example, the guide 240 may include accessory features that imparting a rotational motion to the support driver 250 as it moves along the guide 240. For example, the guide 240 may include teeth and/or cams that engage complementary features on the support driver 250 and impart a rotational motion as the support 230 moves along the guide 240. In some embodiments of the inventive concept release and/or encircling or wrapping of the flexible bladder 210 may be aided by rotational motion imparted to the support 230 as it moves along the guide 240. In such embodiments of the inventive concept the guide 240 may include secondary accessory features that impart a rotational motion to the support 230 as it moves along the guide 240. For example, the guide 240 may include teeth, gears, and/or cams that engage secondary complementary features on the support 230 and impart a rotational motion as the support moves along the guide 240. It should be appreciated that a single feature or set of features on the guide 240 may serve as both accessory features and secondary accessory features. It should also be appreciated that fluid communication with the environment through the perforate vessel 200 advantageously prevents a buildup of pressure within the perforate vessel 200 as the flexible bladder 210 increases in volume.

Figure 3A:
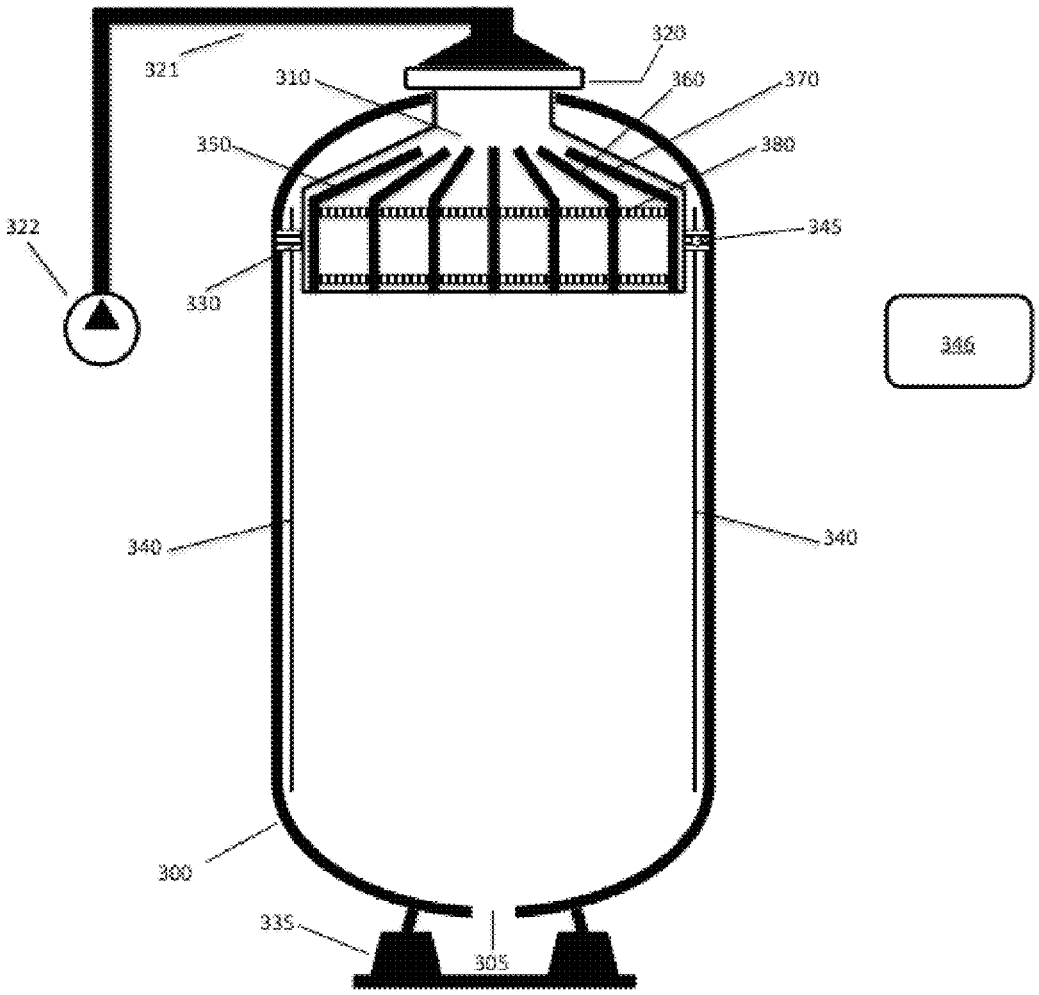
FIG. 3A illustrates a subsea fluid storage system utilizing a flexible bladder, where the flexible bladder is empty.
Figure 3B:
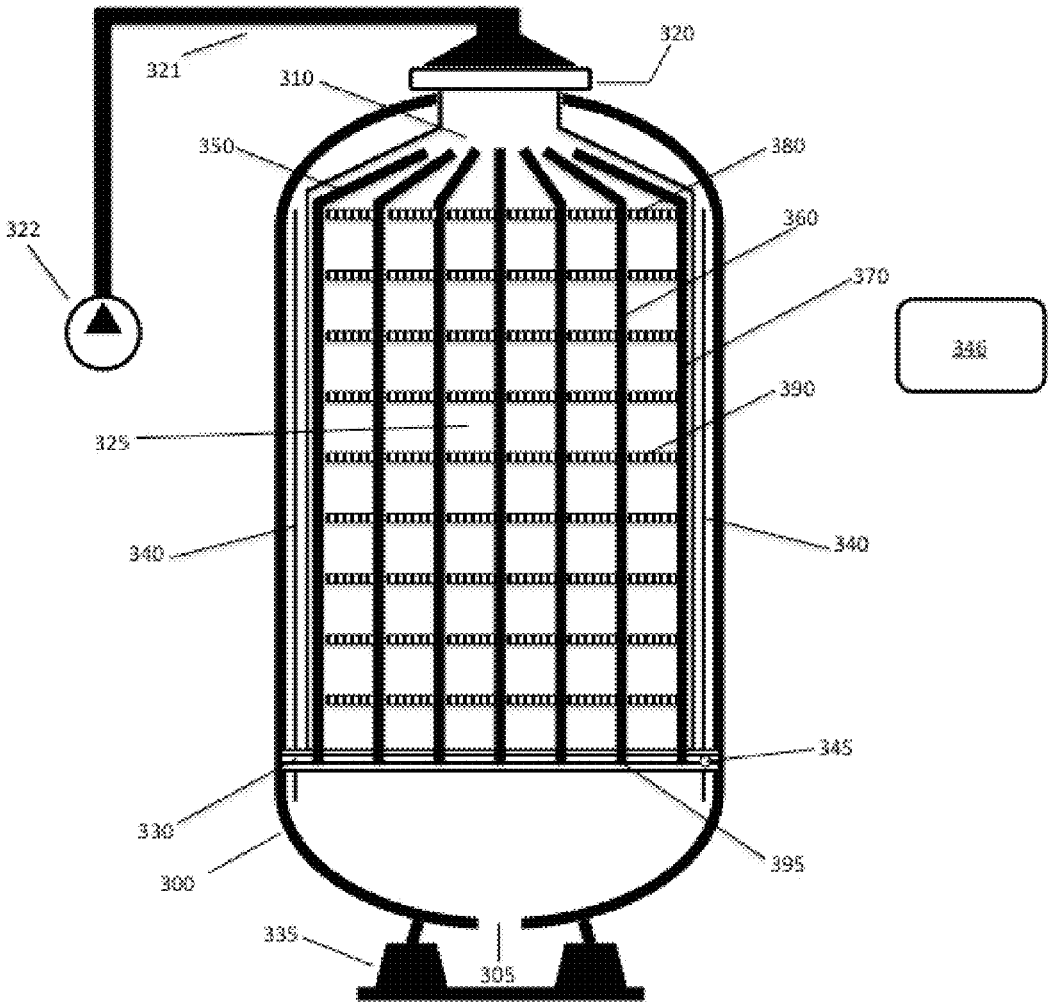
FIG. 3B illustrates the system with the flexible bladder filled.

FIGS. 3A-3B illustrate another embodiment of the inventive concept. FIG. 3A shows a flexible bladder 310 within a perforate vessel 300 that includes an aperture through which extends a flange 320 (such as a neck flange) of the flexible bladder 310 and an opening 305 that permits equalization of pressure between the inside and the outside of the perforate vessel 300; in the state shown the flexible bladder 310 is empty or nearly empty. A conduit 321 (such as a pipe or similar structure) may be utilized in conjunction with an actuator 322 (for example, a pump) to transfer fluids to and/or from the flexible bladder 310 through the flange 320. An anchoring element 335 may be affixed to the perforate vessel 300, permitting the subsea storage system to be fixed in place. Such an anchoring element 335 may, for example, affix a perforate vessel 300 to the seabed and/or a portion of an existing subsea structure. A portion of the flexible bladder 310 encircles or is wrapped around a support 330. The support 330 engages a guide 340, which controls and/or guides its movement as the flexible bladder 310 is filled. A sensor 345 may be utilized to provide a signal or data related to the position of the support 330 to a controller 346. The signal from such a sensor 345 may be utilized by a controller 346 to provide information related to the fill state or volume of the flexible bladder 310

As noted above, a sensor 345 may be utilized to provide a signal or data related to the position of the support 330 and/or a support anchor 395. In some embodiments of the inventive concept one or more sensor(s) 345 may be associated with the support 330, and configured to provide a signal on sensing features incorporated into the guide 340. For example, contact, magnetic, and/or optical flags may be placed along the guide 340 that provide a signal when proximate to a sensor 356. Alternatively, a plurality of sensors may be associated with the guide 340, and configured to provide a signal on sensing the passage of the support 330 and/or a support anchor 395 as the volume of the flexible bladder 310 changes. In still other embodiments of the inventive concept, a sensor 345 may monitor movements made by the support 330 (for example, measuring rotation of the support 330 via an accelerometer or characterizing distance of the support 330 from an ultrasonic sensor affixed to the vessel 300). In yet other embodiments of the inventive concept a sensor 345 may monitor energy stored in one or more support driver(s) 350, 360, 370, for example through the use of a force and/or torsion sensor. It should be appreciated that while FIGS. 3A-3B show a sensor 345 that is proximal to a support 330, it is envisioned that such a sensor 356 may be positioned at any location suitable to its function, for example in and/or upon a support driver 350, 360, 370. The sensor signal may be transmitted or otherwise provided to a controller 346, which may utilize such data to determine the volume of the flexible bladder 310. For example, data related to the position of the support 330 within the perforate vessel 300 may be utilized by a controller 346 in conjunction with data related to the geometry of the flexible bladder 310 to derive a fill volume for the flexible bladder 310. Alternatively, fill volume may be obtained empirically by filling the flexible bladder 310 with one or more known volumes of fluid and recording a signal related to the position of support 330 at each volume prior to deployment of the subsea storage system. A controller 346 could be configured to compare signals obtained from a sensor 345 in the field to such data and report a fill state or volume for the flexible bladder 310. Such information may be utilized to, for example, optimize plant operations by distributing fluid storage to different members of a series of storage systems or to provide a notice or warning to an operator.

In such an embodiment of the inventive concept the flexible bladder 310 may include one or more support driver(s) 350, 360, 370 that are coupled to the support 330 and to the flexible bladder 310. In embodiments of the inventive concept with two or more support drivers 350, 360, 370, adjacent drivers (for example 360 and 370) may be separated by one or more spacers 380. Such a support driver(s) 350, 360, 370 may, for example, be imbedded within (and/or between layers of) the flexible bladder 310. Alternatively, a support driver(s) 350, 360, 370 may be affixed to an internal and/or external surface of the flexible bladder 310 by, for example, an adhesive, rivets, and/or other suitable methods that maintain the fluid integrity of the flexible bladder 310. Suitable support drivers include (but are not limited to) a spring, a flexible polymer and/or rubber, a segment of the material utilized in the construction of the flexible bladder 310, and/or any suitable device for storing torsional or rotational energy. In some embodiments of the inventive concept the support driver(s) 350, 360, 370 may be one or more regions of the flexible bladder 310 with increased thickness. In a preferred embodiment of the inventive concept, the support driver(s) 350, 360, 370 is a flat and/or ribbon spring that is affixed to an external surface of the flexible bladder 310, and is affixed to the support 330 at or near a terminus of the spring. In some embodiments of the inventive concept, the support driver(s) 350, 360, 370 have an approximately helical configuration when the flexible bladder 310 is empty and at least a portion of the flexible bladder 310 encircles the support 330 (as shown in FIG. 3A). A support driver(s) 350, 360, 370 may be urged into a linear configuration by forces applied by the flexible bladder 310 as it is filled (as shown in FIG. 3B). The support driver(s) 350, 360, 370 and support 330 are configured so that tension provides an moving force is applied to the support 330 that drives the support 330 towards the flange 320. It should be appreciated that this impelling force may be applied when the flexible bladder 310 is empty, has a density greater than that of the surrounding media, and/or the support 330 is proximal to the flange 320. This advantageously braces the flange 320, relieving stress from the weight of the flexible bladder 310 and reducing or eliminating the possibility of tearing of the flexible bladder 310.

In some embodiments of the inventive concept the fluid storage system may be filled by a conduit 321 that is in fluid communication with the flange 320, eventually filling (as shown in FIG. 3B) or partially filling the flexible bladder 310. An actuator 322 (for example, a pump) may used to facilitate this process. As the flexible bladder 310 is filled a reservoir portion 325 distends and is released from encircling the support 330; in doing so the support 330 moves away from the flange 320 and along the guide 340. In this process the support driver (s) 350, 360, 370 may be urged and/or tensioned into an approximately linear shape. In addition, one or more additional spacer(s) 390 may be exposed. In some embodiments of the inventive concept a least a portion of the support 330 may be exposed when the flexible bladder 310 is in a filled state; similarly, one or more support anchor(s) 395 that couple a support driver 350, 360, 370 to a support 330 may be exposed. When fluid is removed from the flexible bladder 310 the filling process is essentially reversed, with force from the support driver(s) 350, 360, 370 impelling the support 330 towards the flange 320 along the guide 340 as it (or they) return to an approximately helical configuration. This advantageously aids in encircling or wrapping the flexible bladder 310 around the support 330 as it moves towards the flange 320 during the emptying process. In some embodiments of the inventive concept release and/or encircling or wrapping of the flexible bladder 310 may be aided by rotational motion imparted to the support 330 as it moves along the guide 340. In such embodiments of the inventive concept the guide 340 may include features that imparting a rotational motion to the support 330 as it moves along the guide 340. For example, the guide 340 may include teeth, gears, and/or cams that engage complementary features on the support 330 and impart a rotational motion as the support moves along the guide 340.

It should be appreciated that utilization of a support that is coupled to the flexible bladder and that is moved towards the neck flange advantageously permits a fluid storage system of the inventive concept to be utilized for storage of a wide variety of fluids without the induction of damaging stress upon the flexible bladder. Stresses applied to the neck flange of a fluid storage system of the may vary with the fluid stored within the flexible bladder. For example, if the density of the fluid or fluid mixture stored within the flexible bladder exceeds that of the surrounding medium, stress upon a neck flange may be increased as the flexible bladder is filled if such a support were not provided. Alternatively, if the density of the fluid or fluid mixture stored within the flexible bladder is less than or equal to that of the surrounding medium stress upon a neck flange may be increased as the flexible bladder is emptied if such a support were not provided. Similarly, utilization of a support for a flexible bladder that is moved towards the neck flange can provide support for the neck flange when the flexible bladder is in empty, filled, and partially filled states.

It should also be appreciated that packing methods other than encircling or wrapping of the flexible bladder are also encompassed by the inventive concept. A flexible bladder constructed of suitably thin materials may crumple or compact in essentially random folds. Alternatively, a flexible bladder may be, for example, compressed by folding in pleats and/or in the manner of a set of bellows. Similarly, a flexible bladder may be stored by folding in alternating directions tangent to the path traveled by a support coupled to the flexible bladder. In such embodiments the flexible bladder may incorporate features that support the packing method. For example, a flexible bladder of the inventive concept may include indentations, creases, folds, pleats, and/or alternating regions of decreased thickness and/or increased flexibility that facilitate packing on removal of fluid from the flexible bladder. Similarly, a support coupled to the flexible bladder may perform accessory movements as it travels along a guide that facilitate such packing methods. For example, a support may perform alternating movements tangent to the path of the guide in order to facilitate folding of the flexible bladder.

Likewise, it should be appreciated that a subsea storage system of the inventive concept may incorporate one or more sensors that may be used to provide additional information useful to operations. Examples of such sensors include, but are not limited to, flow rate sensors, temperature sensors, pressure sensors, stress and/or position sensors coupled to an anchoring element, and/or chemical sensors. Signals and/or data from such sensors may be provided to a controller. This controller may, in turn, be configured to provide warnings and/or notifications to a user. Alternatively, a controller may be configured to actuate valves, control pump speeds, adjust tensioning lines associated with anchoring structures, and/or other operations that support safe and effective utilization of the subsea storage system. In especially preferred aspects, one or more sensors are used to assist in indirect determination of the fill level of the bladder. For example, suitable sensors will include those that determine the absolute (or a relative) position of the support. The position of the support is then used as a proxy for the fill level.

Flexible bladders of the inventive concept may be constructed of any suitable flexible or pliant material. Suitable materials include, but are not limited to, flexible films, fabrics, impregnated fabrics, polymers, rubber and/or reinforced rubber, and combinations thereof. Capacity of flexible bladders of the inventive concept may range from 500 $cm^3$ to 1,000 $m^3$. In other embodiments of the inventive concept the capacity of the flexible bladder may range from 500 cm3 to 5,000 $m^3$. In still other embodiments of the inventive concept the capacity of the flexible bladder may be up to 10,000 $m^3$ or more. Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

As noted above, subsea storage systems of the inventive concept may include an anchoring element. Such an anchoring element may be coupled directly or indirectly to the perforate vessel that encloses at least a portion of a flexible bladder used for fluid storage. Such an anchoring element may be any suitable structure that stabilizes the position of the subsea storage system against internal stresses (such as buoyancy) and external stresses (such as waves, currents, and/or impacts). In some embodiments of the inventive concept the anchoring element may be a vertical load anchor, a suction imbedded plate anchor, a fluke anchor, a driven plate anchor, a drag embedment near load anchor, a pile embedment near normal load anchor, a suction pile, a driven pile, and/or similar traction-generating mechanism that engages the seabed or other adjacent subsea features with sufficient force to overcome the buoyancy of the subsea storage structure and environmental stresses, such as waves, currents, and impacts. In other embodiments the anchoring element may be a foundation that is sufficiently weighted to provide positional stability to the subsea storage structure. Such a foundation may be reversibly weighted, for example through the use of ballast tanks, thereby permitting the subsea storage structure to be moved if so desired. In still other embodiments an anchoring element may be a grapple or clamp that engages an existing subsea structure. Such a grapple or clamp may be configured to disengage when so desired, permitting the subsea storage structure to be repositioned or moved to a different location. In some embodiments of the inventive concept more than one anchoring element may be incorporated into the subsea storage structure; in such an embodiment these anchoring elements may be of different types.

It should be appreciated that a wide variety of fluid materials may be stored in fluid storage system of the inventive concept. Such fluids may include (for example), materials vented during petrochemical operations (natural gas, methane, hydrogen sulfide, etc.), carbon dioxide, petroleum, drilling muds and/or slurries, and/or surfactants. In some embodiments of the inventive concept a plurality of fluids may be stored in the fluid storage system. These fluid materials may range in density from $10^{-5}$ g/cm$^3$ to 10 g/cm$^3$. Alternatively, fluid materials stored in the fluid storage system may range in density from $10^{-3}$ g/cm$^3$ to 8 g/cm$^3$. In other embodiments of the inventive concept fluid materials stored in the fluid storage system may range in density from 0.1 g/cm$^3$ to 5 g/cm$^3$.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A subsea fluid storage system, comprising;

a perforate vessel;

a flexible bladder coupled to and at least partially disposed within the perforate vessel and comprising a neck flange;

a support that is coupled to the flexible bladder and is movably coupled to the perforate vessel;

a support driver configured to move at least a portion of the support towards the neck flange of the flexible bladder;

an anchoring element coupled to and configured to secure the perforate vessel to a seabed;

a sensor operationally coupled to the support and configured to generate a signal as a function of a position of the at least portion of the support; and wherein the flexible bladder is configured to be movable between a first state in which the at least portion of the support is proximal to the neck flange, and a second state in which the support is distal to the neck flange.

2. The fluid storage system of claim 1, wherein the support is configured to brace the neck flange when the subsea fluid storage system is in the first state.

3. The fluid storage system of claim 1, wherein the support is an axle.

4. The fluid storage system of claim 1, wherein the support driver is a resilient member.

5. The fluid storage system of claim 1, wherein the support driver is coupled to a terminus of the support.

6. The fluid storage system of claim 1, wherein the support driver is coupled to the flexible bladder.

7. The fluid storage system of claim 1, wherein at least a portion of the support driver is within a lumen of the support.

8. The fluid storage system of claim 1, further comprising a controller operationally coupled to the sensor and configured to convert the signal into data representative of a filling state of the flexible bladder.

9. A flexible bladder assembly for subsea fluid storage, comprising:

a flexible bladder having a neck flange and a bladder terminus that has a support anchor, wherein the flexible bladder forms a reservoir for subsea fluid storage;

a support configured to move between a first state that is coincident with the first state of the flexible bladder and a second state that is coincident with the second state of the flexible bladder;

wherein the flexible bladder is configured to be movable between a first state in which the support anchor is proximal to the neck flange, and a second state in which the support anchor is distal to the neck flange;

a sensor configured to provide a signal that differentiates between the first state of the support and the second state of the support to a controller; and wherein the neck flange is configured to supportingly retain the flexible bladder in a subsea perforate vessel.

10. A method for subsea fluid storage in a subsea fluid storage system, comprising;

introducing a fluid to an interior of a flexible bladder of the subsea fluid storage system through a neck flange, thereby displacing at least a portion of a support from the neck flange in a distal direction along a guide of the subsea fluid storage system;

measuring, by a sensor that is operationally coupled to the at least portion of the support, a filling state of the flexible bladder; and removing the fluid from the interior of the flexible bladder, thereby moving the at least a portion of the support in a proximal direction to the neck flange; and, wherein the step of removing the fluid is performed using an actuator and the at least portion of the support is moved by reversibly deforming the flexible bladder from a second to a first state.

11. The method of claim 10, wherein the neck flange is braced by the support when the flexible bladder is empty.

12. The method of claim 10, wherein the fluid is introduced to the fluid storage system by a conduit in fluid communication with the neck flange.

13. The method of claim 10, wherein the fluid is one or more fluids selected from the group consisting of chemicals utilized for chemical injection in deep sea petrochemical operations, back flush liquids from deep sea petrochemical operations, discharge from deep sea petrochemical operations, gases utilized in deep sea petrochemical operations, and gases produced by deep sea petrochemical operations.

14. The method of claim 10, wherein the fluid storage system further comprises a sensor configured to supply a signal related to the position of the support.

15. The method of claim 14, wherein the signal from the sensor is utilized to estimate the volume of the flexible bladder.

* * * * *